US009044958B2

(12) United States Patent
Pines et al.

(10) Patent No.: US 9,044,958 B2
(45) Date of Patent: Jun. 2, 2015

(54) IMAGE FORMING APPARATUS AND METHODS THEREOF

(75) Inventors: Assaf Pines, Rehovot (IL); Nassim Henn, Nes Ziona (IL); Chen Talmor, Givat ada (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/232,983

(22) PCT Filed: Jul. 20, 2011

(86) PCT No.: PCT/EP2011/062437

§ 371 (c)(1),
(2), (4) Date: Jan. 15, 2014

(87) PCT Pub. No.: WO2013/010586

PCT Pub. Date: Jan. 24, 2013

(65) Prior Publication Data

US 2014/0160189 A1 Jun. 12, 2014

(51) Int. Cl.
*B41J 2/195* (2006.01)
*G03G 15/10* (2006.01)

(52) U.S. Cl.
CPC ..... *B41J 2/195* (2013.01); *G03G 15/10* (2013.01); *G03G 2215/0658* (2013.01)

(58) Field of Classification Search
CPC ..... G03G 15/10; G03G 15/5041; G03G 2215/00037; G03G 15/0824; G03G 2215/0658; B41J 2/195; B41J 2/0057; B41J 29/393; B41J 2202/20; B41J 2/2056; B41J 2/17566; B41J 2/2107
See application file for complete search history.

(56) References Cited

U.S. PATENT DOCUMENTS

| | | | | |
|---|---|---|---|---|
| 5,923,930 | A | 7/1999 | Tsukamoto et al. | |
| 6,115,561 | A * | 9/2000 | Fukushima | 399/49 |
| 2008/0181671 | A1 | 7/2008 | Oda | |
| 2008/0317490 | A1 | 12/2008 | Yogome | |

FOREIGN PATENT DOCUMENTS

WO WO-00/02096 A1 1/2000

OTHER PUBLICATIONS

PCT Search Report/Written Opinion—Application No. PCT/EP2011/062437 dated Mar. 15, 2012—10 pages.
US 5,083,165, 01/1992, Landa (withdrawn)

* cited by examiner

*Primary Examiner* — Thinh Nguyen

(57) ABSTRACT

Image forming apparatus and methods are disclosed which include identifying a first ink density of ink in an ink tank by a density sensor unit disposed in the ink tank. The image forming apparatus and methods also include identifying an ink weight of ink in an intermediate reservoir by a weight sensor unit. The image forming apparatus and methods also include determining a second ink density of the ink in the intermediate reservoir based at least on the identified first ink density by the density sensor unit and the identified ink weight of the ink in the intermediate reservoir by the weight sensor unit.

15 Claims, 5 Drawing Sheets

IMAGE FORMING APPARATUS AND METHODS THEREOF

BACKGROUND

Image forming apparatuses such as a liquid electrophotography printing apparatus includes providing ink such as liquid toner to an ink applicator unit such as binary ink developers. The ink applicator unit provides charged liquid toner to a latent image on a photoconductive member to form ink images. The photoconductive member transfers the ink images onto an image transfer member and/or media.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
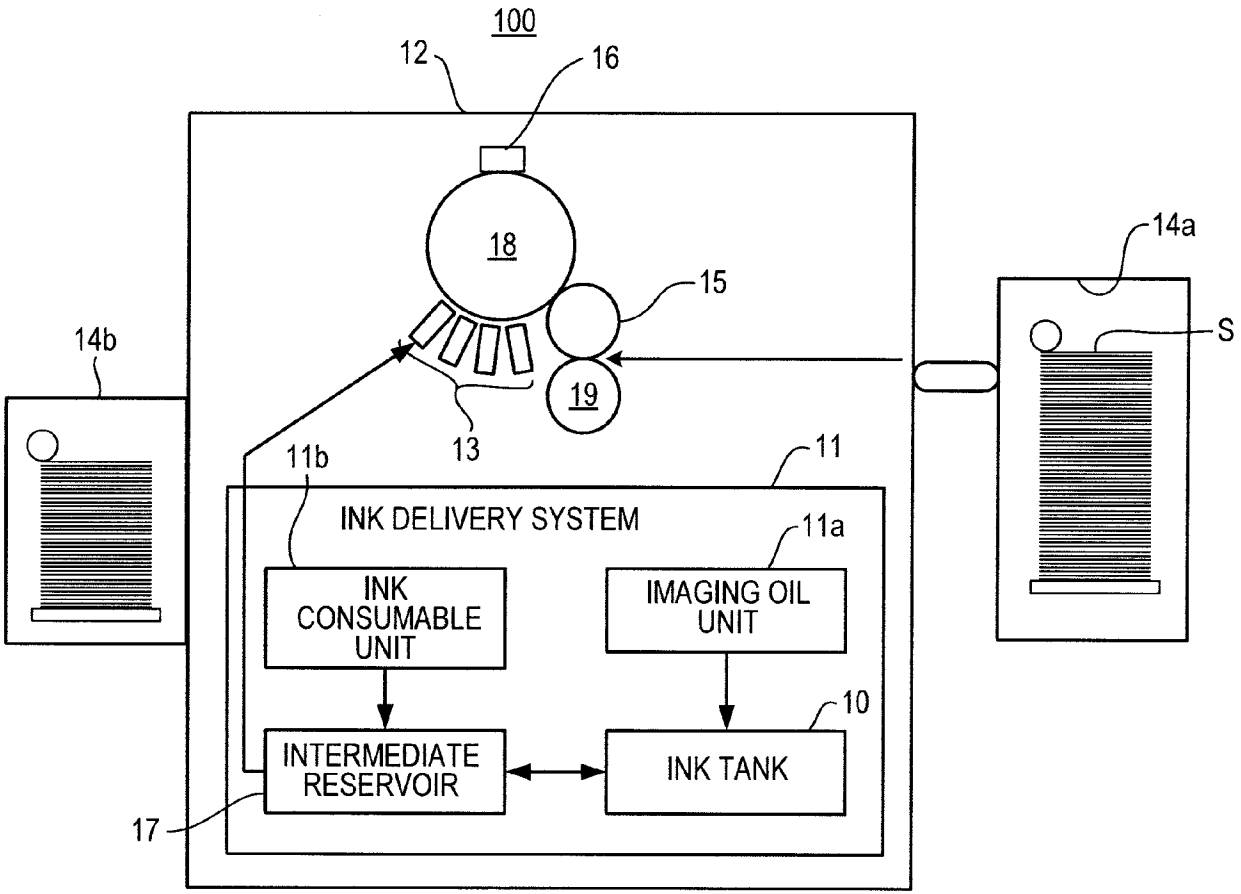
FIG. 1 is a schematic view illustrating an image forming apparatus such as a liquid electrophotography printing apparatus according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses such as a liquid electrophotography printing apparatus (LEP) provides ink such as liquid toner and carrier fluid such as imaging oil from an ink tank to an ink applicator unit such as binary ink developers (BIDs). The liquid toner is charged and is provided to a latent image on a photoconductive member such as a photo imaging member (PIP) to form an ink image, for example, by BIDs. The photoconductive member, in turn, provides the image to an intermediate transfer member such as an image transfer blanket. The image transfer blanket transfers the image onto media. The ink density (e.g., ink solids density, concentrated ink solids density, and the like) and an amount of ink in the ink tank, however, may fluctuate beyond an acceptable range and/or value. Accordingly, maintaining control of the quantity and ink density of the ink in the ink tank may be adversely impacted. Consequently, overflows may occur due to a large amount of printed ink cover applied on the media in forming images thereon. Additionally, ink density control may be adversely impacted during ink consumable unit replacement.

In examples, an ink density control method of an image forming apparatus includes, among other things, identifying a first ink density of ink in an ink tank by a density sensor unit disposed in an ink tank, and identifying an ink weight of ink in an intermediate reservoir by a weight sensor unit. The ink density control method may also include determining a second ink density of the ink in the intermediate reservoir based at least on the identified first ink density by the density sensor unit and the identified ink weight by the weight sensor unit. In examples, the ink density control method may also include back flowing an amount of ink in the ink tank to the intermediate reservoir approximately equal to the amount of the ink received by the ink tank from the intermediate reservoir in response to the amount of the ink from the intermediate reservoir flowing into the ink tank.

Thus, the intermediate reservoir may be used as a buffer even while an ink consumable unit is being replaced. Accordingly, control of the quantity and ink density of the ink in the ink tank and intermediate reservoir may be maintained even during ink consumable unit replacement. Thus, overflowing of at least the ink tank due to a large amount of printed ink cover applied on the media in forming images thereon may be reduced. Further, respective ink density of the ink in the ink tank and the intermediate reservoir may be determined based on a density sensor unit disposed in the ink tank.

FIG. 1 is a schematic view illustrating an image forming apparatus such as a liquid electrophotography system (LEP) according to an example. Referring to FIG. 1, an image forming apparatus 100 includes an image forming unit 12 that receives media S from an input unit 14*a* and outputs the media S to an output unit 14*b*. The image forming unit 12 includes an ink applicator unit 13 and a photoconductive member 18 on which images can be formed. The photoconductive member 18 may be charged with a suitable charger (not illustrated) such as a charge roller. Portions of the outer surface of the photoconductive member 18 that correspond to features of the image can be selectively discharged by a laser writing unit 16 to form an electrostatic and/or latent image thereon. The image forming apparatus 100 also includes an ink delivery system 11 including an imaging oil unit 11*a*, an ink consumable unit 11*b*, at least one ink tank 10, and at least one intermediate reservoir 17.

In examples, the ink applicator unit 13 may include one BID. In other examples, the ink applicator unit 13 may include a plurality of BIDs in which each BID may correspond to a respective color ink such as black ink, cyan ink, yellow ink, and magenta ink. Accordingly, the image forming apparatus 100 may include a plurality of ink tanks and a plurality of intermediate reservoirs corresponding therewith. Thus, one ink tank 10 and one corresponding intermediate reservoir 17 may correspond to each BID applying a different color ink. The imaging oil unit 11*a* may supply imaging oil such as Isopar trademarked by Exxon Corporation to the ink tank 10. The ink consumable unit 11*b* may supply concentrated ink such as concentrated liquid toner to the intermediate reservoir 17, for example, to maintain a predetermined amount of ink density of the ink therein. The intermediate reservoir 17 may receive ink from the ink tank 10, for example, when the ink tank 10, in response to receiving an amount of ink from the intermediate reservoir 17 to increase ink density of the ink in the ink tank 10, back flows an amount of ink approximately equal to the amount of ink received from the intermediate reservoir 17 to the intermediate reservoir 17. The intermediate reservoir 17 may provide ink to the ink tank 10, for example, when the ink density of the ink in the ink tank 10 is less than a predetermined ink tank ink density.

Referring to FIG. 1, the ink tank 10 may supply ink such as liquid toner, for example. ElectroInk, trademarked by Hewlett-Packard Company, to an ink applicator unit 13. The ink applicator unit 13 applies the ink such as liquid toner to the electrostatic and/or latent image to form an ink image on the photoconductive member 18 to be transferred to an intermediate transfer member (ITM) 15. The ITM 15 is configured to receive the ink image from the photoconductive member 18 and transfer the ink image to the media S. During the transfer of the ink image from the ITM 15 to the media S, the media S is pinched between the ITM 15 and an impression member 19. Once the ink image has been transferred to the media S, the media S can be transported to the output unit 14*b*.

Figure 2:
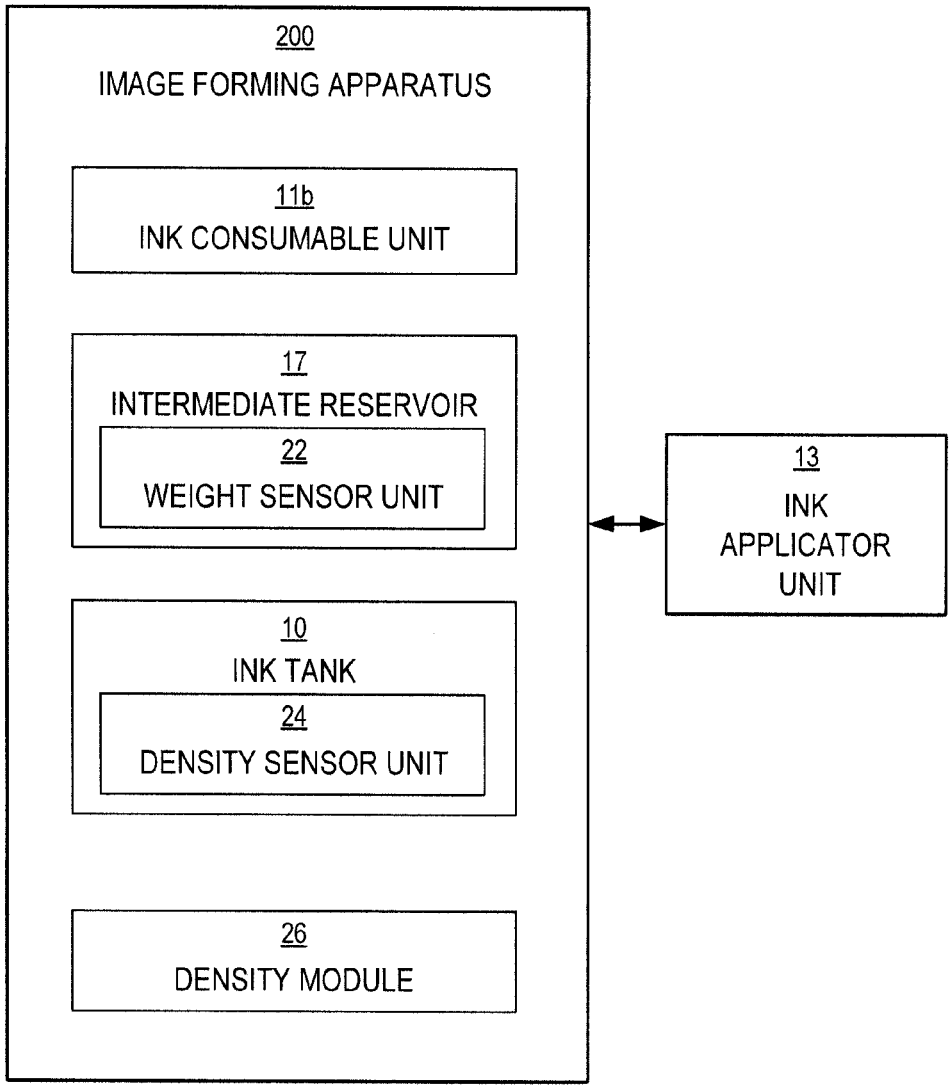
FIG. 2 is a block diagram illustrating an image forming apparatus usable with an ink applicator unit according to an example.
Figure 3A:
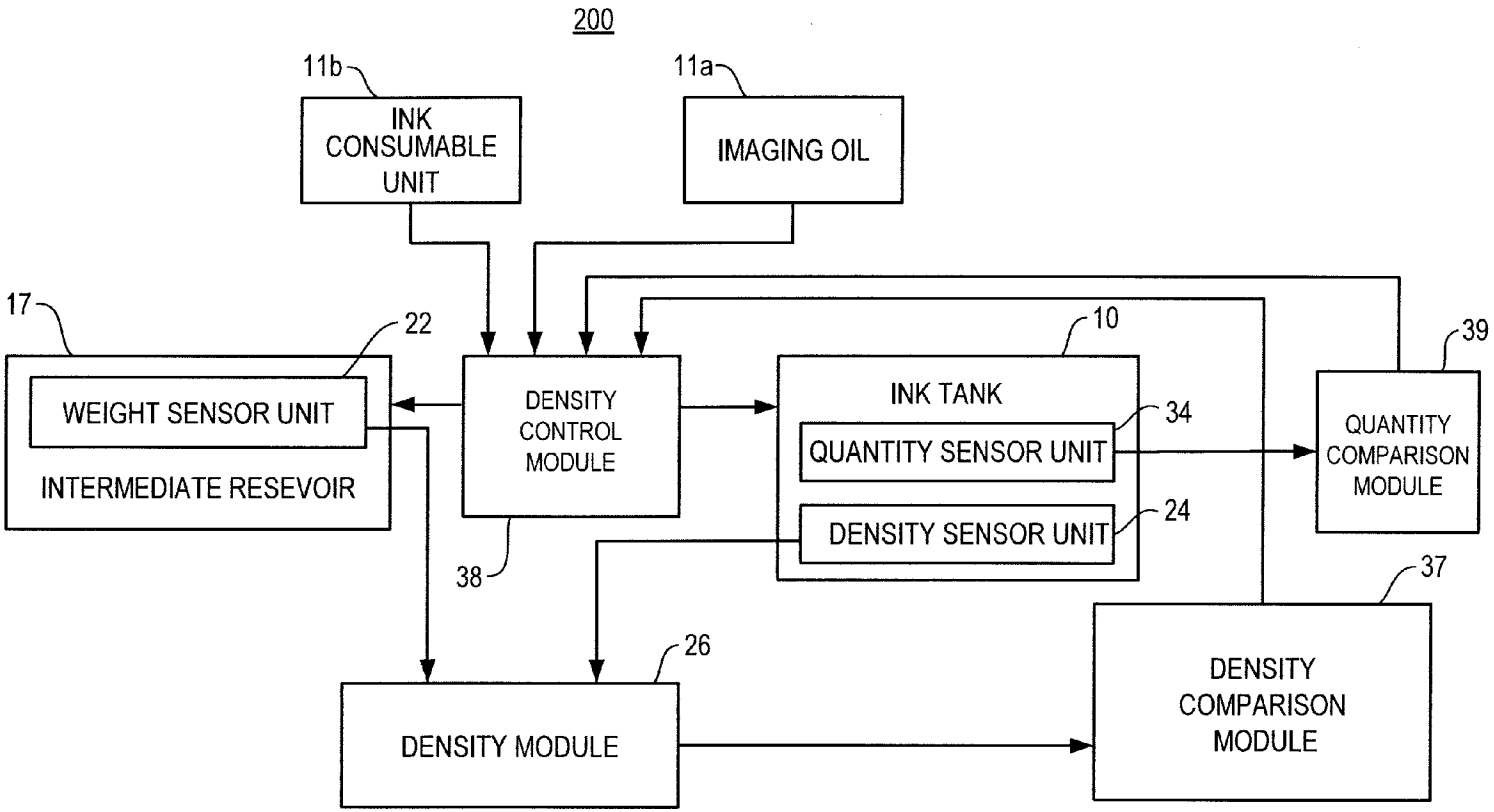
FIG. 3A is a schematic view illustrating the image forming apparatus of FIG. 2 according to an example.

FIG. 2 is a block diagram illustrating an image forming apparatus usable with an ink applicator unit according to an example. An ink applicator unit 13, for example, may include an inkjet print head, BID as previously disclosed with respect to FIG. 1, and the like. FIG. 3A is a schematic view illustrating the image forming apparatus of FIG. 2 according to an example. Referring to FIGS. 2 and 3A, in examples, the image forming apparatus 200 usable with an ink applicator unit 13 includes an ink consumable unit 11*b*, an ink tank 10 including a density sensor unit 24, an intermediate reservoir 17 including a weight sensor unit 22, and a density module 26. In examples, the image forming apparatus 200 may include a plurality of corresponding sets of ink tanks and intermediate reservoirs (not illustrated). In examples, an image forming apparatus 200 may be a digital copier, printer, bookmaking machine, facsimile machine, multi-function machine, and the like.

The ink consumable unit 11*b* is configured to store a consumable ink therein. For example, the consumable ink may include a high solid ink concentrate such as concentrated liquid toner. In examples, the concentrated liquid toner has a consumable ink density of about 40%. That is, the ink density may be represented as a percentage corresponding to a mass of ink solids in a solution divided by total solution mass. The imaging oil unit 11*a* may supply imaging oil to the ink tank 10. The ink tank 10 is configured to store ink therein and to selectively provide the ink 10 to the ink applicator unit 13. The amount of ink supplied to the ink applicator unit 13 and/or the ink density of the ink in the ink tank 10 may vary due to a number of printed images formed by the ink applicator unit 13 and an amount of corresponding printed ink cover applied on the media therefrom. The density sensor unit 24 is disposed in the ink tank 10. The density sensor unit 24 is configured to identify a first ink density of the ink in the ink tank 10. In examples, a predetermined ink tank ink density of the ink in the ink tank 10 may be about 4.5%. That is, the ink density may be represented as a percentage corresponding to a mass of ink solids in a solution divided by total solution mass.

Referring to FIGS. 2 and 3A, in examples, the intermediate reservoir 17 is configured to store ink therein. The intermediate reservoir 17 is selectively in fluid communication with the ink consumable unit 11*b* and the ink tank 10. For example, fluid communication may be established through a density control module 38 to control the flow of ink between the intermediate reservoir 17 and the ink consumable unit 10*b*, between the intermediate reservoir 17 and the ink tank 10, and/or between the imaging oil unit 11*a* and the ink tank 10. A second ink density of the ink in the intermediate reservoir 17 may be determined and, for example, used to maintain the ink therein. In examples, the predetermined reservoir ink density may be about 16%. That is, the ink density may be represented as a percentage corresponding to a mass of ink solids in a solution divided by total solution mass. The weight sensor unit 22 is configured to identify an ink weight of the ink in the intermediate reservoir 17. In examples, the weight sensor unit 22 may be disposed in contact with the intermediate reservoir 17. For example, the weight sensor unit 22 may be in a form of a load cell disposed in contact with an exterior surface of the intermediate reservoir 17 to determine the weight of the ink in the intermediate reservoir 17. In examples, the weight sensor unit 17 may be in contact with an internal surface of the intermediate reservoir 17.

Referring to FIGS. 2 and 3A, in examples, the density module 26 is configured to determine the second ink density of the ink in the intermediate reservoir 17 based at least on the identified first ink density and the identified ink weight of the ink in the intermediate reservoir 17. For example, the density module 26 may determine the second ink density by calculating a derivative of an ink density of the ink in the ink tank with respect to a weight change of the ink in the intermediate reservoir 17 before and after a corresponding ink density correction to the ink in the ink tank 10 and correlating the derivative to the second ink density of the ink in the intermediate reservoir 17. The ink density correction, for example, may be changing the ink density of the ink in the ink tank 10 by providing ink from the ink reservoir to the ink tank. In examples, calculation of the derivative may include using a first ink density of the ink in the ink tank 10 before an ink density correction is performed to the ink in the ink tank 10 and a second ink density of the ink in the ink tank 10 achieved as a result of the ink density correction performed to the ink in the ink tank 10. Additionally, the density module 26 may determine the second ink density by correlating the calculated derivative to the second ink density of the ink in the intermediate reservoir 17.

In examples, the derivative of the ink density of the ink in the ink tank 10 may be represented by a corresponding equation such as Equation 1 identified below.

EQUATION 1 $D_{it}=(d_{it2}-d_{it1})/(w_{ir2}-w_{ir1})$, wherein

- $D_{it}$ corresponds to a derivative of an ink density of ink in an ink tank 10;
- $d_{it1}$ corresponds to an identified first ink density of the ink in the ink tank 10 before an ink density correction is performed to the ink in the ink tank (e.g., increasing the identified first ink density of the ink in the ink tank 10);
- $d_{it2}$ corresponds to the second ink density of the ink in the ink tank 10 achieved as a result of the ink density correction performed to the ink in the ink tank 10;
- $w_{ir1}$ corresponds to an identified ink weight of ink in an intermediate reservoir 17 before the ink density correction is performed to the ink in the ink tank 10; and
- $w_{ir2}$ corresponds to the identified ink weight of the ink in the intermediate reservoir 17 after the ink density correction is performed to the ink in the ink tank 10.

In examples, the density module 26 may be implemented in hardware, software, or in a combination of hardware and software. For example, the density module 26 may include a set of density machine-readable instructions to determine the second ink density of the ink in the intermediate reservoir 17 which may include, for example, calculating a derivative such as Equation 1, and correlating the calculated derivative. In examples, the density module 26 may be implemented in whole or in part as a computer program such as the set of density machine-readable instructions stored in the image forming apparatus 200 locally or remotely. For example, the computer program may be stored in a memory such as a server or a host computing device 50 (FIG. 5) considered herein, in examples, as part of the image forming apparatus 200.

Figure 3B:
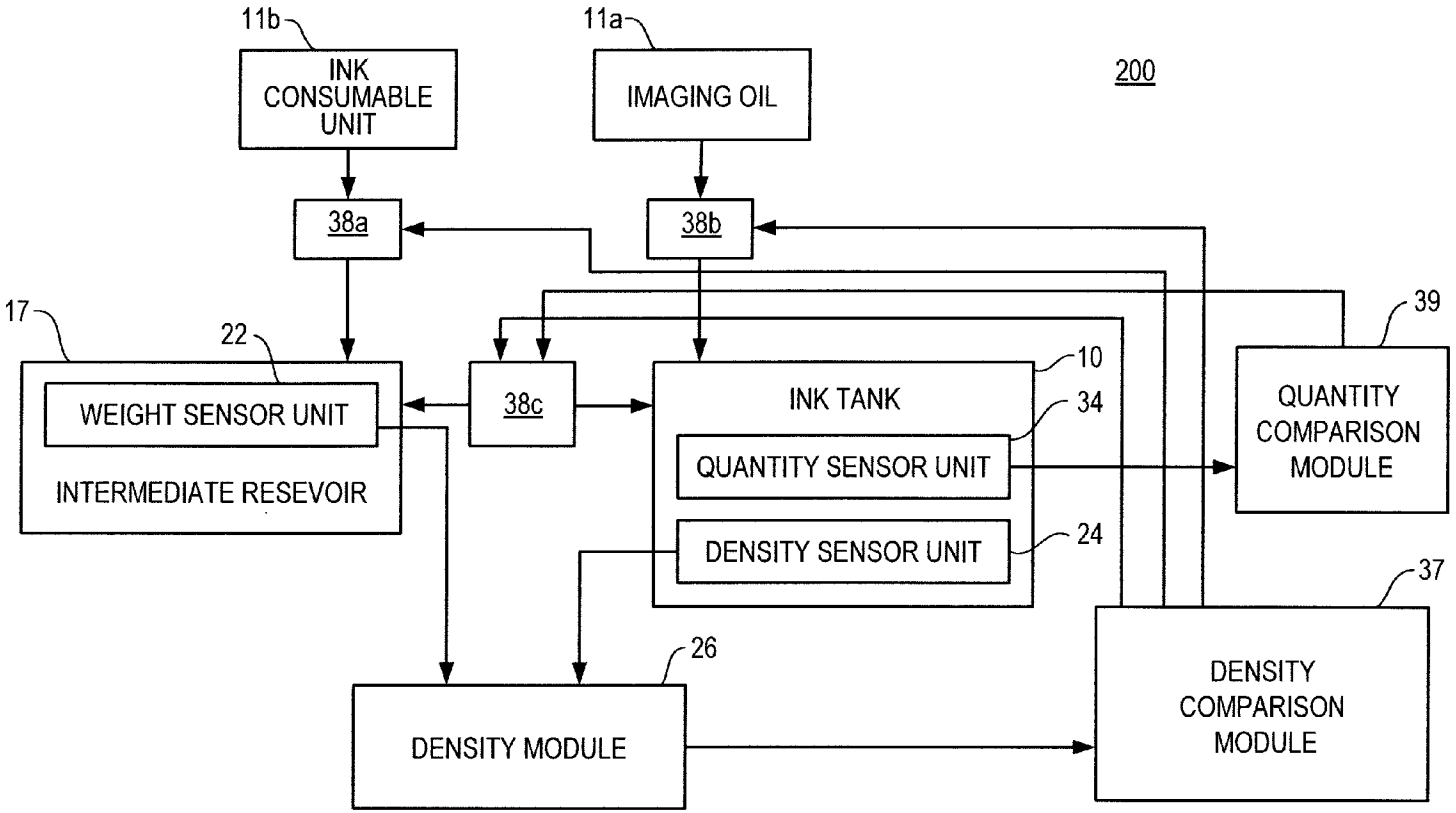
FIG. 3B is a schematic view illustrating the image forming apparatus of FIG. 3A including a density control module according to an example.

FIG. 3B is a schematic view illustrating the image forming apparatus of FIG. 3A including a density control module according to an example. Referring to FIGS. 3A and 38, in examples, the image forming apparatus 200 may also include a density control module 38, a density comparison module 37, a quantity sensor unit 34, and a quantity comparison module 39. In examples, the density control module 38 is configured to increase the first ink density and increase the second ink density. For example, the density control module 38 may selectively establish fluid communication between the ink tank 10 and the intermediate reservoir 17.

In examples, the ink in the intermediate reservoir 17 may have a second ink density thereof greater than the first ink density and an amount of the ink may flow from the intermediate reservoir 17 to the ink tank 10. The establishment of such ink flow may be in response to determination by the density comparison module 37 that an identified first ink density is less than a predetermined ink tank ink density. For example, the density control module 38 may also selectively establish fluid communication between the intermediate reservoir 17 and the ink consumable unit 10*b*. The consumable ink in the ink consumable unit 10*b* may have a predetermined consumable ink density greater than the second ink density and the consumable ink may flow from the ink consumable unit 10*b* to the intermediate reservoir 17. The establishment of such ink flow may be in response to the determination by the density comparison module 37 that the determined second ink density is less than the predetermined reservoir ink density.

In examples, the density control module 38 may be implemented in hardware, software, or in a combination of hardware and software. For example, the density control module 38 may include one or more programmable valves 38*a* and 38*b*, pumps such as a two-way pump 38*c*, and the like, to control fluid communication between the ink tank 10, the intermediate reservoir 17, the ink consumable unit 10*b*, and/or the imaging oil unit 10*a*. In examples, programmable valve 38*a* may selectively open and close to control consumable ink flow from the ink consumable unit 10*b* to the intermediate reservoir 17. For example, programmable valve 38*b* may selectively open and close to control imaging oil flow from the imaging oil unit 10*a* to the ink tank 10. Additionally, the two-way pump 38*c*, for example, may selectively be turned on to control ink flow (e.g., fluid communication) between the ink tank 10 and the intermediate reservoir 17. The two-way pump 38*c* may be disposed between the ink tank 10 and the intermediate reservoir 17. In examples, the two-way pump 38*c* is configured to selectively provide a direction of fluid communication between the intermediate reservoir 17 and the ink tank 10 established by the two-way pump 38*c*.

Referring to FIGS. 3A and 3B, in examples, the density comparison module 37 is configured to determine whether the identified first ink density is less than the predetermined ink tank ink density. The density comparison module 37 is configured to also identify whether the determined second ink density is less than a predetermined reservoir ink density of the ink in the intermediate reservoir 17. In examples, the predetermined reservoir ink density is greater than the predetermined ink tank ink density. Additionally, the predetermined reservoir ink density is also less than a predetermined consumable ink density of the consumable ink in the ink consumable unit 10*b*. In examples, the density comparison module 37 may be implemented in hardware, software, or in a combination of hardware and software. For example, the density comparison module 37 may include a set of density comparison machine-readable instructions. The set of density comparison machine-readable instructions may compare the identified first ink density and the predetermined ink tank ink density to determine whether the identified first ink density is less than the predetermined ink tank ink density.

The set of density comparison machine-readable instructions may also compare the determined second ink density and the predetermined reservoir ink density to determine whether the second ink density is less than the predetermined reservoir ink density. The set of density comparison machine-readable instructions may initiate the opening and closing of the programmable valves 38*a* and 38*b* based on the respective determinations thereof. In examples, the density comparison module 37 may be implemented in whole or in part as a computer program such as a set of density comparison machine-readable instructions stored in the image forming apparatus 200 locally or remotely. For example, the computer program may be stored in a memory such as a server or a host computing device 50 considered herein as part of the image forming apparatus 200.

In examples, the image forming apparatus 200 may also include a quantity sensor unit 34 disposed in contact with the ink tank 10. That is, the quantity sensor unit 34 may in contact with an external surface or an internal surface of the ink tank 10. The quantity sensor unit 34 may be configured to identify an amount of ink in the ink tank 10. In examples, the identified amount may be represented as a volume, weight, capacity level, and the like. The quantity sensor unit 34, for example, may be a load cell disposed outside of the ink tank 10 to weight the weight of the ink in the ink tank 10. Referring to FIGS. 3A and 3B, in examples, the quantity comparison module 39 is configured to determine whether the identified amount of ink in the ink tank is at least one of equal to and less than a predetermined lower tank limit. The quantity comparison module 39 may also determine whether an amount of the ink in the intermediate reservoir is at least one of equal to and greater than a predetermined upper reservoir limit. In examples, the quantity comparison module 39 may also determine whether the identified amount of ink in the ink tank 10 is at least one of equal to and greater than a predetermined upper tank limit and whether the identified amount of ink in the intermediate reservoir 17 is at least one of equal to and lower than a predetermined lower reservoir limit.

The predetermined upper tank limit may correspond to a desired maximum amount of ink to be stored in the ink tank 10. The predetermined lower tank limit may correspond to a desired minimum amount of ink to be stored in the ink tank 10. The predetermined upper reservoir limit may correspond to a desired maximum amount of ink to be stored in the intermediate reservoir 17. The predetermined lower reservoir limit may correspond to a desired minimum amount of ink to be stored in the intermediate reservoir 17. In examples, the predetermined upper tank limit, the predetermined lower tank limit, the predetermined upper reservoir limit, and the predetermined lower reservoir limit may be stored in a look-up table. In examples, based on at least one of the respective predetermined upper ink tank limit, the predetermined lower tank limit, the predetermined upper reservoir limit, and the predetermined lower reservoir limit determinations by the quantity comparison module, for example, various paths of fluid communication may be established. For example, based on the determination that the ink in the ink tank 10 has not reached the lower tank limit, fluid communication is established from the imaging oil unit 11*a* to the ink tank 10 to at least increase the ink level in the ink tank 10.

In examples, the quantity comparison module 39 may be implemented in hardware, software, or in a combination of hardware and software. For example, the quantity comparison module 39 may include a set of quantity comparison machine-readable instructions. The set of quantity comparison machine-readable instructions may compare the identified amount of ink in the ink tank 10 with the predetermined upper tank limit and/or the predetermined lower tank limit. The set of quantity comparison machine-readable instructions may also determine whether the identified amount of ink in the ink tank 10 is at least one of equal to and greater than a predetermined upper tank limit and/or whether the identified amount of ink in the ink tank 10 is at least one of equal to and less than a predetermined lower tank limit. The set of quantity comparison machine-readable instructions may also determine whether an amount of the ink in the intermediate reservoir 17 is at least one of equal to and greater than a predetermined upper reservoir limit and/or whether an amount of the ink in the intermediate reservoir 17 is at least one of equal to and less than a predetermined lower reservoir limit.

In examples, the quantity comparison module 39 may be implemented in whole or in part as a computer program such as a set of quantity comparison machine-readable instructions stored in the image forming apparatus 200 locally or remotely. For example, the computer program may be stored in a memory such as a server or a host computing device 50 considered herein as part of the image forming apparatus 200.

Figure 4:
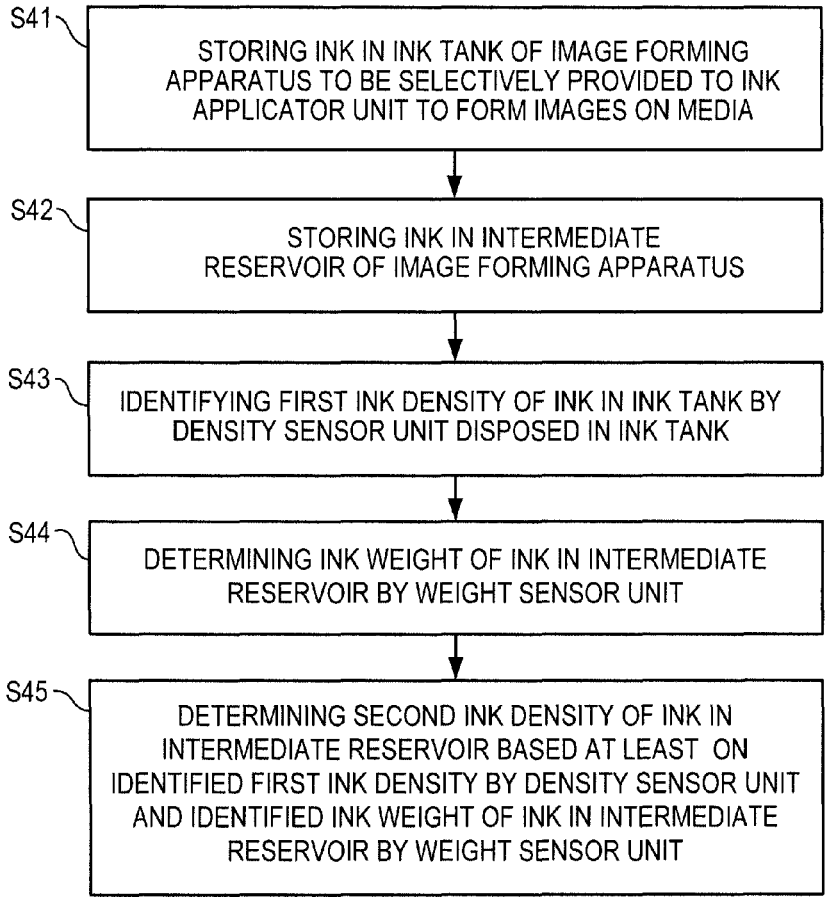
FIG. 4 is a flowchart illustrating an ink density control method of an image forming apparatus according to an example.

FIG. 4 is a flowchart illustrating an ink density control method of an image forming apparatus according to an example. In block S41, ink is stored in an ink tank of an image forming apparatus to be selectively provided to an ink applicator unit to form images on media. In block S42, ink is stored in an intermediate reservoir of the image forming apparatus. In block S43, a first ink density of the ink in the ink tank is identified by a density sensor unit disposed in the ink tank. In block S44, an ink weight of the ink in the intermediate reservoir is identified by a weight sensor unit. In block S45, a second ink density is determined based at least on the identified first ink density by the density sensor unit and the identified ink weight of the ink in the intermediate reservoir by the weight sensor unit. The weight sensor unit, for example, is disposed in contact with the intermediate reservoir. In examples, the determination of the second ink density may include calculating a derivative of an ink density of the ink in the ink tank with respect to a weight change of the ink in the intermediate reservoir before and after a corresponding ink density correction to the ink in the ink tank, and correlating the calculated derivative to the second ink density.

The ink density control method may also include determining whether the identified first ink density is less than a predetermined ink tank ink density, and increasing the identified first ink density in response to the determination of the identified first ink density that is less than the predetermined ink tank ink density. For example, increasing the identified first ink density may include selectively establishing fluid communication between the ink tank and the intermediate reservoir such that an amount of the ink in the intermediate reservoir flows from the intermediate reservoir to the ink tank. The ink in the intermediate reservoir may have a second ink density thereof greater than the identified first ink density. The ink density control method may also include back flowing an amount of ink in the ink tank to the intermediate reservoir approximately equal to the amount of the ink received by the ink tank from the intermediate reservoir in response to the amount of the ink from the intermediate reservoir flowing into the ink tank. The ink density control method may also include a selection of the direction of fluid communication between the intermediate reservoir and the ink tank established by a two-way pump disposed therebetween.

In examples, establishment of a fluid communication between the intermediate reservoir and the ink tank by a two-way pump disposed therebetween based on a selection of a direction of fluid communication, for example, may be in response to the determination of the identified first ink density of at least one of equal to and greater than the predetermined upper ink tank ink density by the density comparison module 37. In examples, establishment of a fluid communication between the intermediate reservoir and the ink tank by a two-way pump disposed therebetween based on a selection of a direction of fluid communication, for example, may be in response to the determination of the identified first ink density that is at least one of equal to and greater than the predetermined upper ink tank ink density by the density comparison module 37. In examples, establishment of a fluid communication between the intermediate reservoir and the ink tank by a two-way pump disposed therebetween based on a selection of a direction of fluid communication, for example, may be in response to the determination of the identified first ink density at least one of equal to and less than the predetermined lower ink tank ink density by the density comparison module 37.

The ink density control method may also include a determination of whether the second ink density is less than a predetermined reservoir ink density, and an increase to the second ink density to the predetermined reservoir ink density in response to the determination of the second ink density that is less than the predetermined reservoir ink density. For example, the increase to the second ink density of the ink in the intermediate reservoir may include selectively establishing fluid communication between the intermediate reservoir and an ink consumable unit of the image forming apparatus such that a consumable ink flows from the ink consumable unit to the intermediate reservoir. The consumable ink in the ink consumable unit may have a consumable ink density greater than the second ink density.

The ink density control method may also include identification of an amount of the ink in the ink tank by a quantity sensor unit, and a determination of whether the identified amount of ink in the ink tank is at least one of equal to and greater than a predetermined upper tank limit by a quantity comparison module. The ink density control method may also include maintaining a reservoir ink amount in the intermediate reservoir within a predetermined reservoir amount range and an ink tank ink amount in the ink tank within a predetermined ink tank amount range by the density control module. The maintaining may be based on the determination of the identified amount of the ink in the ink tank that is at least one of equal to and greater than the predetermined upper tank limit by the quantity comparison module. The ink density control method may also include selection of a direction of fluid communication between the intermediate reservoir and the ink tank established by a two-way pump disposed therebetween.

Figure 5:
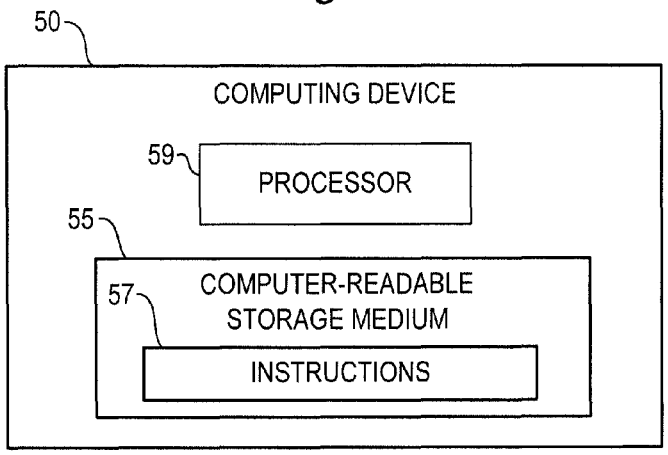
FIG. 5 is a block diagram of the ink density control method of FIG. 4 embodied in a computer-readable storage medium according to an example.

FIG. 5 is a block diagram of the method of FIG. 4 embodied in a computer-readable storage medium according to an example. Referring to FIG. 5, in examples, the present disclosure may be embodied in any computer-readable storage medium 55 for use by or in connection with an instruction-execution system, apparatus or device such as a computer/processor based system, processor 59 or other system (e.g., computing device 50) that can fetch the instructions from the instruction-execution system, apparatus or device, and execute the instructions 57 contained therein. In the context of this disclosure, a computer-readable storage medium 55 can store, communicate, propagate or transport instructions 57 for use by or in connection with the computing device 50 such as an image forming apparatus 200. The computer-readable storage medium 55 can include any one of many physical media such as, for example, electronic, magnetic, optical, electromagnetic, infrared, or semiconductor media.

More specific examples of computer-readable storage medium 55 would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable storage medium 55 could even be paper or another suitable medium upon which the instructions 57 are printed, as the instructions 57 can be electronically captured, via, for instance, optical scanning of the paper or other medium, then compiled, interpreted or otherwise processed in a single manner, if necessary, and then stored therein. The computer-readable storage medium 55 includes instructions 57 executed, for example, by the processor 59 and, that when executed, cause the processor 59 and/or computing device 50 to perform some or all of the functionality described herein.

It is to be understood that the flowchart of FIG. 4 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be scrambled relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An ink density control method of an image forming apparatus, the ink density control method comprising:

storing ink in an ink tank of an image forming apparatus to be selectively provided to an ink applicator unit to form images on media;

storing ink in an intermediate reservoir of the image forming apparatus;

identifying a first ink density of the ink in the ink tank by a density sensor unit disposed in the ink tank;

identifying an ink weight of the ink in the intermediate reservoir by a weight sensor unit; and determining a second ink density of the ink in the intermediate reservoir based at least on the identified first ink density by the density sensor unit and the identified ink weight of the ink in the intermediate reservoir by the weight sensor unit.

2. The ink density control method according to claim 1, further comprising:

determining whether the identified first ink density is less than a predetermined ink tank ink density; and increasing the identified first ink density in response to the determination of the identified first ink density that is less than the predetermined ink tank ink density.

3. The ink density control method according to claim 2, wherein the increasing the identified first ink density comprises:

selectively establishing fluid communication between the ink tank and the intermediate reservoir such that an amount of the ink in the intermediate reservoir having the second ink density thereof greater than the identified first ink density flows from the intermediate reservoir to the ink tank.

4. The ink density control method according to claim 3, further comprising:

back flowing an amount of ink in the ink tank to the intermediate reservoir approximately equal to the amount of the ink received by the ink tank from the intermediate reservoir in response to the amount of the ink from the intermediate reservoir flowing into the ink tank.

5. The ink density control method according to claim 3, further comprising:

determining whether the second ink density is less than a predetermined reservoir ink density; and increasing the second ink density in response to the determination of the second ink density that is less than the predetermined reservoir ink density.

6. The ink density control method according to claim 5, wherein the increasing the second ink density comprises:

selectively establishing fluid communication between the intermediate reservoir and an ink consumable unit of the image forming apparatus such that a consumable ink having a consumable ink density greater than the second ink density flows from the ink consumable unit to the intermediate reservoir.

7. The ink density control method according to claim 1, wherein determining a second ink density based at least on the identified first ink density and the identified ink weight of the ink in the intermediate reservoir comprises:

calculating a derivative of an ink density of the ink in the ink tank with respect to a weight change of the ink in the intermediate reservoir before and after a corresponding ink density correction to the ink in the ink tank; and correlating the calculated derivative to the second ink density.

8. The ink density control method according to claim 1, further comprising:

identifying an amount of the ink in the ink tank by a quantity sensor unit;

determining whether the identified amount of ink in the ink tank is at least one of equal to and less than a predetermined lower tank limit by a quantity comparison module; and maintaining an ink tank ink amount in the ink tank within a predetermined ink tank amount range by the density control module establishing fluid communication from the imaging oil unit to the ink tank.

9. An image forming apparatus usable with an ink applicator unit, the image forming apparatus comprising:

an ink consumable unit configured to store a consumable ink therein;

an ink tank configured to store ink therein and to selectively provide the ink in the ink tank to an ink applicator unit;

a density sensor unit disposed in the ink tank, the density sensor unit configured to identify a first ink density of the ink in the ink tank;

an intermediate reservoir configured to store ink therein, the intermediate reservoir selectively in fluid communication with the ink consumable unit and the ink tank;

a weight sensor unit disposed in contact with the intermediate reservoir, the weight sensor unit configured to identify an ink weight of the ink in the intermediate reservoir; and a density module configured to determine a second ink density of the ink in the intermediate reservoir based at least on the identified first ink density by the density sensor unit and the identified ink weight of the ink in the intermediate reservoir.

10. The image forming apparatus according to claim 9, further comprising:

a density comparison module configured to determine whether the identified first ink density is less than a predetermined ink tank ink density and whether the determined second ink density is less than a predetermined reservoir ink density; and wherein the predetermined reservoir ink density is greater than the predetermined ink tank ink density and less than a predetermined consumable ink density of the consumable ink in the ink consumable unit.

11. The image forming apparatus according to claim 10, further comprising:

a density control module configured to increase the identified first ink density by selectively establishing fluid communication between the ink tank and the intermediate reservoir such that an amount of the ink in the intermediate reservoir having the second ink density thereof greater than the identified first ink density flows from the intermediate reservoir to the ink tank in response to the determination by the density comparison module that the identified first ink density is less than the predetermined ink tank ink density.

12. The image forming apparatus according to claim 11, wherein the density control module is configured to increase the second ink density by selectively establishing fluid communication between the intermediate reservoir and the ink consumable unit such that the consumable ink having the predetermined consumable ink density greater than the second ink density flows from the ink consumable unit to the intermediate reservoir in response to the determination by the density comparison module that the determined second ink density is less than the predetermined reservoir ink density.

13. The image forming apparatus according to claim 9, wherein the density module determines the second ink density of the ink in the intermediate reservoir by calculating a derivative of an ink density of the ink in the ink tank with respect to a weight change of the ink in the intermediate reservoir before and after a corresponding ink density correction to the ink in the ink tank, and correlating the calculated derivative to the second ink density of the ink in the intermediate reservoir.

14. The image forming apparatus according to claim 9, further comprising:

a quantity sensor unit disposed in contact with the ink tank, the quantity sensor unit configured to identify an amount of the ink in the ink tank; and a quantity comparison module configured to determine whether the identified amount of ink in the ink tank is at least one of equal to and less than a predetermined lower tank limit.

15. A computer-readable storage medium having embodied thereon a computer program to execute an ink density control method, wherein the method comprises:

storing ink in an ink tank of an image forming apparatus to be selectively provided to an ink applicator unit to form images on media;

storing ink in an intermediate reservoir of the image forming apparatus;

identifying a first ink density of the ink in the ink tank by a density sensor unit disposed in the ink tank;

identifying an ink weight of the ink in the intermediate reservoir by a weight sensor unit;

determining a second ink density of the ink in the intermediate reservoir based at least on the identified first ink density by the density sensor unit and the identified ink weight of the ink in the intermediate reservoir by the weight sensor unit;

determining whether the first ink density is less than a predetermined ink tank ink density; and increasing the first ink density in response to the determination of the identified first ink density that is less than the predetermined ink tank ink density.

* * * * *

UNITED STATES PATENT AND TRADEMARK OFFICE

CERTIFICATE OF CORRECTION

PATENT NO. : 9,044,958 B2
APPLICATION NO. : 14/232983
DATED : June 2, 2015
INVENTOR(S) : Assaf Pines et al.

It is certified that error appears in the above-identified patent and that said Letters Patent is hereby corrected as shown below:

Title page (75), Inventors, in column 1, line 1, delete "Nassim" and insert -- Nissim --, therefor.

In the Drawings

In sheet 3 of 5, reference numeral 17, line 2 , delete "RESEVOIR" and insert -- RESERVOIR --, therefor.

In sheet 4 of 5, reference numeral 17, line 2 , delete "RESEVOIR" and insert -- RESERVOIR --, therefor.

Signed and Sealed this
Twenty-first Day of June, 2016

Michelle K. Lee

Michelle K. Lee
*Director of the United States Patent and Trademark Office*